US009090370B2

(12) United States Patent
Dods et al.

(10) Patent No.: US 9,090,370 B2
(45) Date of Patent: Jul. 28, 2015

(54) REWIND-REEL DRIVEN LABEL APPLICATOR

(75) Inventors: Steven M. Dods, Marine, IL (US); Adam G. Kneller, Collinsville, IL (US)

(73) Assignee: Illinois Tool Works Inc., Glenview, IL (US)

( * ) Notice: Subject to any disclaimer, the term of this patent is extended or adjusted under 35 U.S.C. 154(b) by 147 days.

(21) Appl. No.: 12/553,779

(22) Filed: Sep. 3, 2009

(65) Prior Publication Data

US 2011/0048608 A1 Mar. 3, 2011

(51) Int. Cl.
*B65C 9/42* (2006.01)
*B65C 9/18* (2006.01)

(52) U.S. Cl.
CPC ..... *B65C 9/1869* (2013.01); *B65C 9/42* (2013.01)

(58) Field of Classification Search
CPC ..... B65C 9/40; B65C 9/42; B65C 9/30; B65C 11/004; B65C 9/1869; B65C 2009/0009
USPC ..... 156/358, 361, 366, 367, 368, 538, 541, 156/351, 362
See application file for complete search history.

(56) References Cited

U.S. PATENT DOCUMENTS

| | | | | |
|---|---|---|---|---|
| 3,231,216 | A | 1/1966 | Lemarchand | |
| 3,630,805 | A | 12/1971 | Fried | |
| 4,294,644 | A * | 10/1981 | Anderson | 156/361 |
| 4,540,017 | A | 9/1985 | Prange | |
| 5,176,334 | A | 1/1993 | Dreschau et al. | |
| 5,256,239 | A | 10/1993 | Voltmer et al. | |
| 5,306,382 | A | 4/1994 | Pichel et al. | |
| 5,698,034 | A * | 12/1997 | Clark et al. | 118/669 |
| 6,179,030 | B1 * | 1/2001 | Rietheimer | 156/360 |
| 6,328,832 | B1 * | 12/2001 | Otruba et al. | 156/64 |
| 6,615,106 | B2 | 9/2003 | Soto et al. | |
| 6,807,998 | B2 | 10/2004 | Dods | |
| 6,817,397 | B2 | 11/2004 | Bixen | |
| 6,823,916 | B2 | 11/2004 | Dods | |
| 6,823,917 | B2 | 11/2004 | Dods | |
| 6,845,800 | B2 | 1/2005 | Dods et al. | |

(Continued)

FOREIGN PATENT DOCUMENTS

| | | | |
|---|---|---|---|
| EP | 0347290 | A1 | 12/1989 |
| GB | 2064471 | A | 6/1981 |

(Continued)

OTHER PUBLICATIONS

International Search Report issued May 19, 1999, in connection with PCT/US99/03887.
International Search Report and the Written Opinion of the International Searching Authority issued on Sep. 5, 2011, in connection with PCT/US2010/047331.

*Primary Examiner* — George Koch
(74) *Attorney, Agent, or Firm* — Levenfeld Pearlstein, LLC

(57) ABSTRACT

A label applicator for separating labels from a continuous carrier strip and applying the labels to an object positioned at the applicator includes a baseplate, a supply reel, a rewind reel, a motor and a rotary encoder. The supply reel is operably mounted to the baseplate and configured for supporting the carrier strip having labels thereon. The rewind reel is also operably mounted to the baseplate and rewinds the carrier strip after label disbursement. The motor is operably connected to the rewind reel and configured for moving or advancing the carrier strip through the applicator, while the rotary encoder controls a linear speed of the carrier strip through the applicator.

12 Claims, 2 Drawing Sheets

(56) References Cited

U.S. PATENT DOCUMENTS

| | | | | |
|---|---|---|---|---|
| 7,193,517 | B2 | 3/2007 | Dods | |
| 2001/0054470 | A1 | 12/2001 | Firehammer | |
| 2006/0249258 | A1* | 11/2006 | Painter et al. | 156/541 |
| 2007/0209755 | A1* | 9/2007 | Smith | 156/249 |
| 2007/0235120 | A1* | 10/2007 | Poole et al. | 156/60 |

FOREIGN PATENT DOCUMENTS

| | | | |
|---|---|---|---|
| WO | 01/05590 | A1 | 1/2001 |
| WO | 2005/037654 | A2 | 4/2005 |
| WO | 2010/018368 | A2 | 2/2010 |

* cited by examiner

REWIND-REEL DRIVEN LABEL APPLICATOR

BACKGROUND OF THE INVENTION

The present invention is directed to a label applicator. More particularly, the present invention pertains to a label applicator that uses web-fed labels, applies those labels to a series of objects, and rewinds the label liner around a rewind reel while maintaining the web at a constant linear speed.

Automated label applicators are well-known in the art. Such a machine feeds a continuous web of material, which includes a carrier strip or liner having labels adhered to the carrier strip at intervals along the carrier strip, and dispenses the labels from the carrier strip onto products on a moving conveyor belt.

After separating the labels from the carrier strip, the carrier strip is accumulated on a rewind or take-up reel for disposal. The carrier strip generally travels over a drive roller and a nip roller before finally reaching the rewind reel. Typically, the driving force for moving the web through the applicator or label machine is provided by a first motor that drives the supply roll while the driving force for collecting the carrier strip is provided by a second motor that drives the rewind reel.

While prior known applicators may suffice, there are several drawbacks associated with known types of applicators. For example, drive rollers generally are of the type formed from a polyurethane material which has a tendency to stick or adhere to other materials. Therefore, when the applicator is to be reloaded with supply, users sometimes must first remove several feet of labels from a leading end of the web prior to installing a new roll. If the leading labels are not removed, they may adhere to the drive and/or nip roller as they pass through. The labels are subsequently very difficult to remove from the drive roller and create a great deal of waste. Another drawback is adhesive from the labels accumulating on the drive and nip rollers causing performance degradation. Other drawbacks include the nip and drive rollers wearing out or the carrier strip slipping from between the nip and drive roller. Either condition may cause the machine to misfeed.

Other issues stem from the speed at which the applicator runs. It is important for the speed of the web through the applicator to remain constant to effectively apply labels to objects; however, changes in weight on the rewind reel can affect the speed of the web through the applicator. Some solutions involve using larger and larger motors in order to maintain a constant speed of label disbursement. Large motors, however, become increasingly expensive and at some point become cost prohibitive. Smaller motors are less expensive, but typically do not sufficiently track the speed of the web to the speed of the products on a conveyor. Inadequate tracking may cause tearing, wrinkling, or other deformation of the labels and the web. In addition, the tracking accuracy of label placement is also important, for example, to prevent placing of the label over product names or logos or other marketing tags. In another example, tracking accuracy is important if the label being placed is a cautionary or directional device, such as arrows, that it need to be placed in a particular orientation on the packaging.

Accordingly, there is a need for a label applicator that uses smaller components, eliminates the drawbacks caused by drive and nip rollers, and provides an easy web path for an operator to re-stock the web material.

BRIEF SUMMARY OF THE INVENTION

A label applicator of the type for separating labels from a continuous carrier strip and applying the labels to an object positioned at the applicator includes a baseplate, a supply reel, a rewind reel, and a motor on the rewind reel. The supply reel is operably mounted to the baseplate and configured for supporting the carrier strip having labels thereon. The rewind reel is operably mounted to the baseplate for rewinding the carrier strip. The motor is operably connected to the rewind reel and configured for moving the carrier strip through the applicator at a constant linear speed. The carrier strip is solely driven through the applicator by the motor on the rewind reel. A rotary encoder is configured for monitoring and helping to control the linear speed of the carrier strip through the applicator.

A method to control the speed of the carrier strip through the label applicator includes continually obtaining readings from an encoder which monitors a linear speed of the carrier strip and operating a controller in at least one of three modes: a label feed speed control mode, a positioning control mode, and an idle control mode. In a label feed mode, the controller accelerates the motor to a predetermined speed and switches to the positioning control mode when a gap between labels is detected. The gap sensors monitor a distance from the gap forward to a full stop position and decelerates the carrier strip to the full stop position when applying the label to the object. The controller then switches to the idle control mode and maintains a tension on the carrier strip until a next signal is received.

In one embodiment, the rotary encoder monitors the linear speed of the carrier strip and communicates with the controller to modify the linear speed of the carrier strip. In another embodiment, the rotary encoder monitors the rotations of the motor per a predetermined period of time and communicates with a controller to modify the linear speed of the carrier strip. In a preferred embodiment, sensors, such as Hall-effect sensors in the motor shaft, monitor the motor speed while the rotary encoder monitors linear speed of the web. In these embodiments, the rotary encoder maintains the linear of speed of the web/carrier strip by continually alerting the controller of changes in linear speed of the web. The rotary encoder may be an absolute or an incremental rotary encoder, an optical or a mechanical rotary encoder. The rotary encoder provides closed-loop feedback to the controller and motor, wherein the motor operably connected to the rewind reel is the only drive mechanism of the applicator.

The carrier strip follows a path through the applicator from the supply reel, around one or more rollers, over a first side of a peel blade, over an edge of the peel blade and then directly under the peel blade. A portion of a rearward path of the carrier strip is parallel to a forward path of the carrier strip. The carrier strip may slide against the second side of the peel blade for a length as it passes directly to the rewind reel. In such an embodiment, the distance between the peel blade and the rewind reel is relatively closer together than in related applicators.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
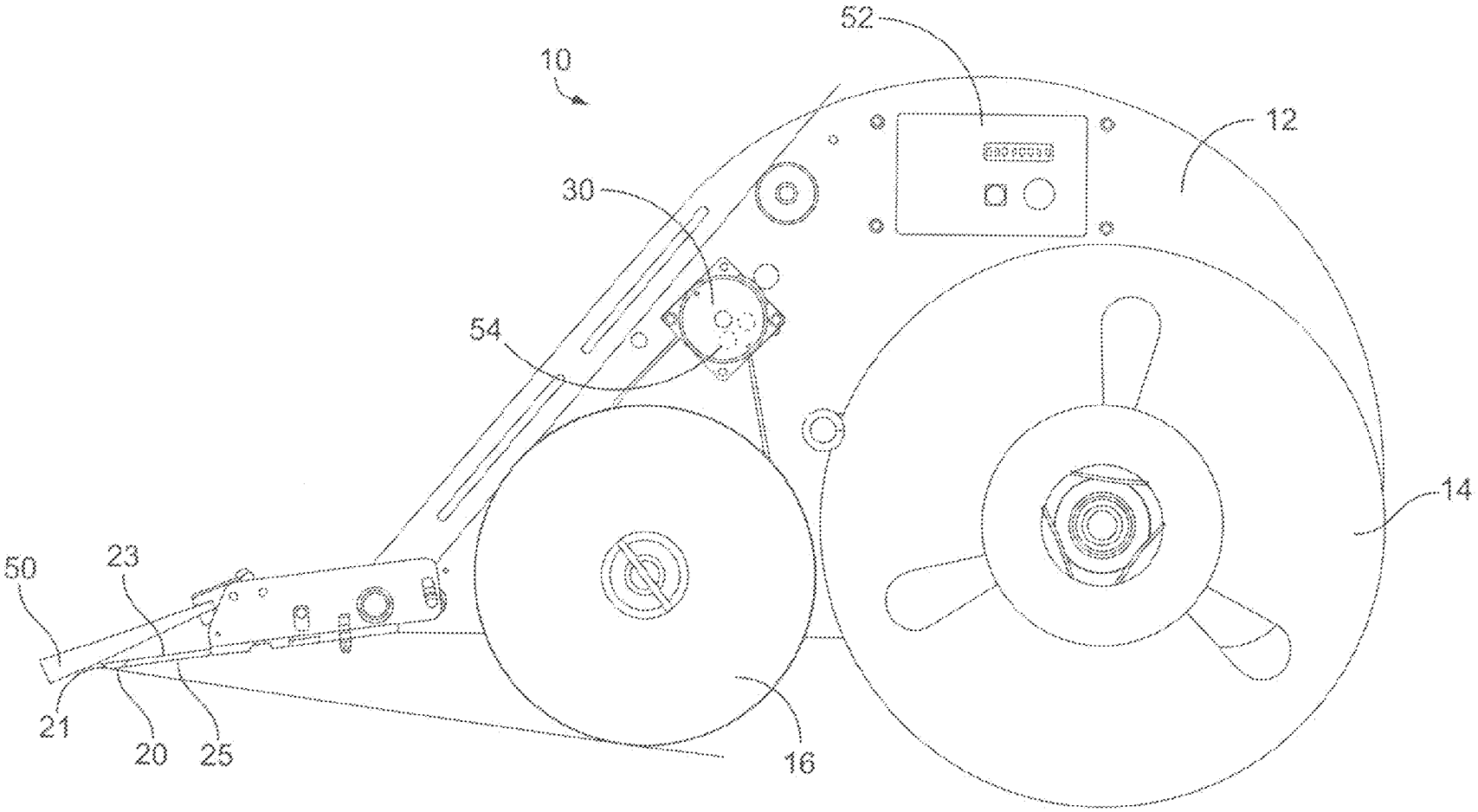
FIG. 1 illustrates a front view of a label applicator in accordance with the principles of the present invention.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

It should be further understood that the title of this section of this specification, namely, "Detailed Description Of The Invention", relates to a requirement of the United States Patent Office, and does not imply, nor should be inferred to limit the subject matter disclosed herein.

Figure 2:
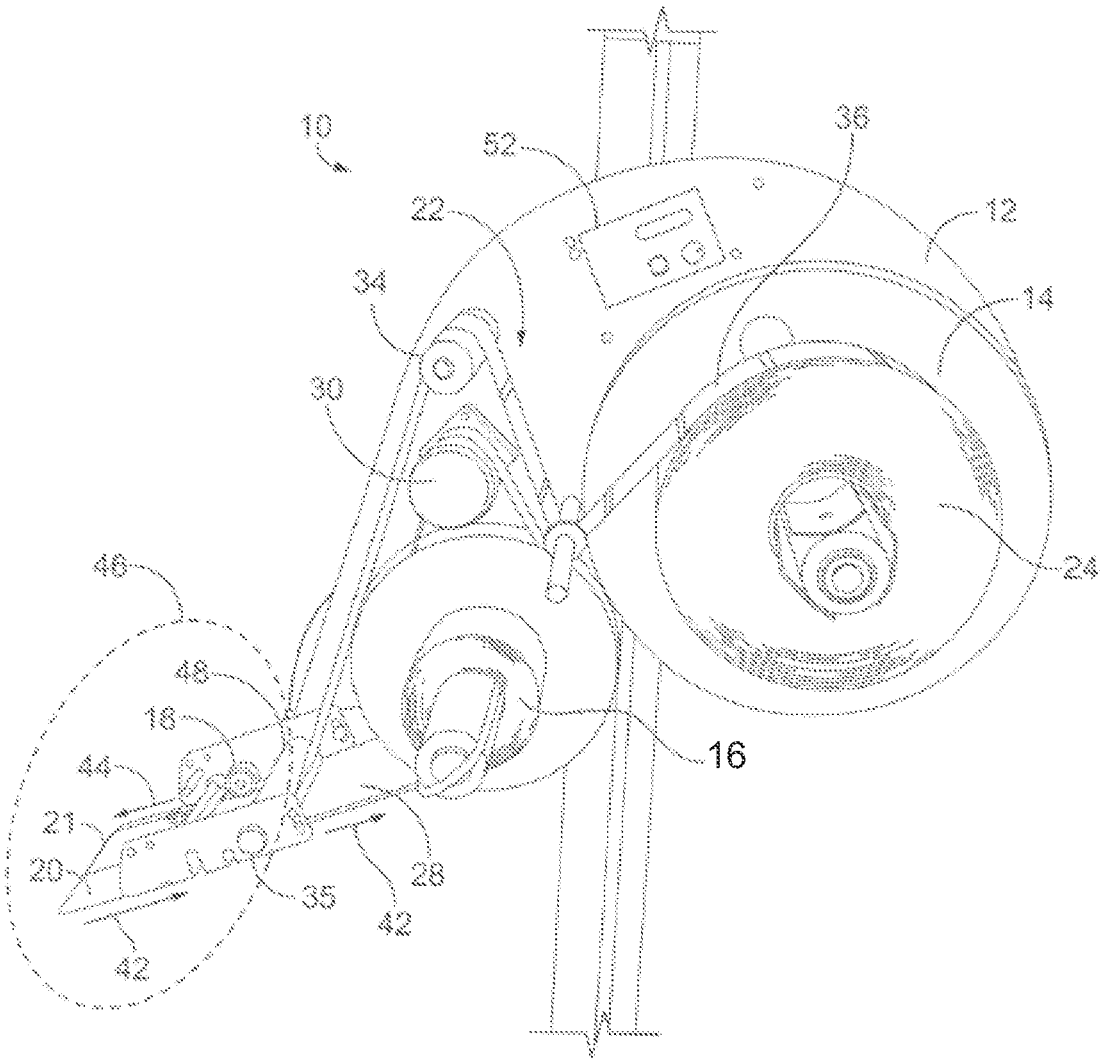
FIG. 2 is a photograph of the label applicator of FIG. 1.

Referring now to FIGS. 1 and 2, there is shown and hereafter described an embodiment of a label applicator in accordance with the principles of the present invention. In general, the label applicator 10 includes a baseplate 12, a supply reel 14, a rewind reel 16, a rotary encoder 18, a motor 30, and a controller 52.

The supply reel 14 is mounted to baseplate 12 and supports a supply roll 24 of web 22. The web 22 includes a liner or carrier strip 28 having labels 36 thereon. For ease of understanding, the term "carrier strip" may be used interchangeably with "web" and may be used herein to describe the carrier strip both with and without labels adhered thereto. The carrier strip 28 is threaded, in a present embodiment, through/around rollers (shown generally at 34, 35) and passes rotary encoder 18. The carrier strip 28 is threaded over an edge 21 of the peel blade 20 and directly under the peel blade, then runs directly to the rewind reel 16. A first end of the carrier strip 28 is secured at the rewind reel 16. Advantageously, labels do not have to be removed prior to the supply roll in order to thread the carrier strip through the applicator 10.

The motor 30 is operably connected to rewind reel 16 and responds to communications from the rotary encoder 18. Together, the motor 30 and the rotary encoder 18 serve to drive the carrier strip 28 through the label applicator 10, maintaining the carrier strip 28 at a linear speed corresponding to each mode or stage of operation.

When the motor 30 is turned on/activated, the rotational force produced by the motor turns the rewind wheel 16 and thus, pulls the carrier strip 28 from the supply reel 14.

The carrier strip 28 advances as the supply reel 14 is passively rotated by action of the motor 30 on the rewind reel 16. The carrier strip 28 is pulled through the applicator 10 to the peel blade 20, in a forward path, shown generally at directional arrow 44, and over a first side 23 of the peel blade 20. A gap sensor 48, which senses an edge of a label on the carrier strip 28, assists in determining the final dispensed position of the label onto products passing adjacent the peel blade 20. A brush 50 smoothes the label onto the product or package.

After dispensing the label, the carrier strip 28 moves over the edge 21 of the peel blade and in a rearward path (shown by directional arrows 42) adjacent to a second side 25 of the peel blade 20. In one embodiment, in one portion, shown generally at 46, the rearward path 42 of the carrier strip 28 runs, parallel to the forward path 44 of the carrier strip 28 and under the same roller 35 as the carrier strip 28 had passed during its forward path 44. The remaining carrier strip 28 then runs directly to the rewind reel 16. There are no drive or nip rollers impeding the carrier strip's path to the rewind reel 16.

During operation of the label applicator 10, the carrier strip 28 accumulates on the rewind reel 16 increasing the weight/mass on the rewind reel. The motor 30 is not only the sole driver of the carrier strip, it is also the sole driver of the increasing mass of the rewind reel; thus, it is necessary to control the motor speed and/or torque in order to maintain constant the linear speed of the carrier strip 28, regardless of the mass on the rewind reel. As those skilled in the art will understand, in response to the increase in mass on the rewind reel 16, the linear speed of the carrier strip at peel blade 20 changes. Control of motor speed is necessary in order to effectively and efficiently position the labels 36 from the carrier strip 28 on objects/products (not shown).

The speed of the carrier strip is monitored in two (2) ways. Sensors 54, such as Hall-effect sensors, in the motor shaft, monitor the motor's speed while a rotary encoder 18 monitors the linear speed of the carrier strip. The sensor(s) 54 and the encoder 18 act in conjunction with one another to marry the speed of the carrier strip and label disbursement to the speed of the products passing adjacent to the applicator.

The rotary encoder 18 accommodates for the gradual increase in the weight/mass of the rewind reel 16 in order to maintain the carrier strip 28 at a constant linear speed. In a preferred embodiment, the rotary encoder monitors the speed of the carrier strip 28 as it passes at the peel blade and communicates with the motor's controller 52 in order to maintain the linear speed of the carrier strip constant. The feedback from the rotary encoder 18 causes the motor to change its torque in response to the change in mass and inertia of the rewind reel 16, using its sensors which monitor the motor shaft rotations (speed). Thus, the carrier strip's linear speed is controlled in a closed loop by the rotary encoder 18 and the motor 30. In a present embodiment, the rotary encoder 18 may be, but is not limited to, an absolute or incremental encoder, a mechanical or an optical encoder.

In one embodiment, the rewind motor control works as follows. The rewind reel motor control voltage (which sets speed) is determine by a PI (Proportional-Integral) controller. In general, a PI controller is a type of feedback controller which drives the process and/or mechanism to be controlled by comparing output values to desired values and accommodating for differences accordingly. It is contemplated that a PID (Proportional-Integral-Differential) controller may also be used. In one embodiment, the PI controller takes readings from the rotary encoder 18 at regular timing intervals to control motor voltage, and thus, motor speed. The PI controller operates in three modes which are dependent on the stage of label feed: label feed speed control mode, positioning control mode, and idle control mode.

In one embodiment, the applicator begins to feed a label where the initial state of the controller is label feed speed control. Label speed is "ramped up" to correspond to a set speed of the product moving on a conveyor; for example, the speed may accelerate from 0 to the set speed in a ramp profile. The label speed is constantly monitored by the encoder to ensure constant speed. Once a label feed signal has been given, the carrier strip (with labels) accelerates to a predetermined feed speed using PI control to control torque. The torque is controlled, in one embodiment, by a current limiting circuit. The current limiting circuit measures the instantaneous current in the motor windings, for all three phases. In one embodiment, the motor is a 3-phase brushless DC motor.

When the current reaches a predetermined threshold, the motor windings duty cycle is modulated to reduce the effective current, and thus, limit the torque for the motor. As label feed speed control mode is in effect, the motor's rotational speed is monitored by the controller. Speed is monitored, in one example, through a hardware feedback signal line measuring a tachometer signal. The tachometer signal is derived from sensors, for example, hall effect sensors, located inside the motor.

The motor speed is used to determine, for example, if there is an error in the system, such as a break in the web material. Such a break may occur when the motor is spinning too fast in relation to the speed read by the encoder.

When a gap is detected, such as after a trailing edge of one label and prior to a leading edge of a next label or where only carrier strip/liner material (without labels) is sensed, the mode of the controller is switched to positioning control mode. In positioning control mode, all of the processes listed in the speed mode described above are used. In addition, positioning control mode begins to track the position of the movement of the carrier strip and labels. While maintaining speed is necessary to place the label flat against the moving product, there is a moment, in an embodiment, when the web is decelerated to avoid over-dispensing of the next label.

The distance from the gap forward to a full stop position is continually measured to determine if the carrier and labels are close to the full stop position, for example, within ½ inch of a full stop position. As the label and carrier strip reach a point that is more proximate to the full stop position, for example, to within ¼ inch of the full stop position, the motor must be ramped down to zero (0) speed. It is understood that distances from the gap to a full stop position may differ and the above mentioned and below referenced measurements are given as an example only.

The carrier strip stops so that more than one label is not disbursed onto a product. In one embodiment, a full stop position may be when a leading edge of a label reaches the peel blade edge or when a trailing end or a middle portion of a label or gap region reaches the peel blade edge. It is contemplated that the full stop position of the web may be modified according to the size and type of labels used.

The amount or length of additional label to be dispensed is determined from the reference point of the trailing edge of the label. The position control mode progressively reduces the speed of the motor when the web has reached ¼ inch or less of the desired position. Once this position has been reached, the speed mode no longer is set to the feed speed (the speed of the product to be labeled), but is reduced by an amount that is proportional to the distance remaining to travel to the final presentation position of the label.

Once the labeling system has reach the final position and/or when the speed reaches zero (0), then the controller enters idle control mode and keeps light tension on the liner. The controller waits for the next request to feed a label, such as on a next product trigger. Idle control mode does not use a control algorithm for closed loop feedback. The motor is left on with a slight bias current to keep the liner from relaxing and causing slack on the rewind. As the roll gets larger, the possibility of creating slack becomes larger, thus, a slight forward current is placed on the motor. The forward current is not sufficient to cause rotation of the motor, but enough to keep tension between the rewind reel and the peel blade. Idle control mode is the default mode of the system when the applicator is not feeding a label.

The advantages of the present system include a simplified web path for an operator to re-thread the carrier strip on change-over or restocking. Also, the labels need not be taken off the carrier strip in order to re-thread the carrier strip on change-over, thus, saving time and preventing waste. In addition, the present system removes the need for drive and nip rollers, thereby decreasing component count and potential points of failure. The decreased component count not only decreases potential failure points, but also decreases the amount of wiring and equipment attached to the back of the base plate, creating a less complicated assembly.

All patents referred to herein, are incorporated herein by reference, whether or not specifically done so within the text of this disclosure.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A label applicator of a type for separating labels from a continuous carrier strip and applying the labels to objects positioned at the applicator, the applicator comprising:

a supply reel configured for supporting the carrier strip having labels thereon;

a rewind reel configured for rewinding the carrier strip, the supply reel and the rewind reel fixed relative to one another;

a motor operably connected to the rewind reel only, the motor configured to drive the rewind reel only for moving the carrier strip through the applicator;

a sensor for sensing a speed of the motor;

a rotary encoder mounted separately from the rewind reel and motor;

a peel blade having a peel blade edge around which the carrier strip is fed and a through/around roller under which the carrier strip is fed so as to extend parallel to the peel blade, the through/around roller disposed upstream from the peel blade edge, wherein the rotary encoder is positioned on the peel blade; and a controller, wherein the rotary encoder monitors a linear speed of the carrier strip and wherein the sensor senses the speed of the motor, and wherein the rotary encoder communicates with the controller to control the linear speed of the carrier strip through the applicator by adjusting the sensed speed of the motor; and wherein the carrier strip is fed along a forward path to be received at the peel blade, and the carrier strip passes from the peel blade to the rewind reel along a rearward path extending from the peel blade to the rewind reel, wherein the forward path is parallel to the rearward path, and the rearward path extends under a roller and to the rewind reel in a single direction only.

2. The label applicator of claim 1, wherein the rotary encoder maintains the linear of speed of the carrier strip constant.

3. The label applicator of claim 1, wherein the rotary encoder is an absolute or an incremental rotary encoder.

4. The label applicator of claim 1, wherein the rotary encoder is an optical or a mechanical rotary encoder.

5. The label applicator of claim 1, wherein the rotary encoder provides closed-loop feedback to the controller.

6. The label applicator of claim 1, wherein the carrier strip passes parallel and adjacent to a first and a second side of the peel blade.

7. The label applicator of claim 1, wherein the motor is the driver of the carrier strip and the driver of the rewind reel.

8. The label applicator of claim 1, wherein the motor includes one or more sensors to monitor a motor speed.

9. The label applicator of claim 1, further comprising a baseplate with the supply reel and the rewind reel operably mounted thereto.

10. A label applicator of a type for separating labels from a continuous carrier strip and applying the labels to an object positioned at the applicator, the applicator comprising:

a baseplate;

a supply reel operably mounted to the baseplate and configured for supporting the carrier strip having labels thereon;

a rewind reel operably mounted to the baseplate and configured for rewinding the carrier strip;

a motor operably connected to the rewind reel only, the motor configured to drive the rewind reel for moving the carrier strip through the applicator, wherein the motor is the sole drive mechanism of the carrier strip via the rewind reel;

a sensor for sensing a speed of the motor;

a controller;

a rotary encoder that monitors a linear speed of the carrier strip; and a peel blade having a peel blade edge around which the carrier strip is fed and a through/around roller under which the carrier strip is fed so as to extend parallel to the peel blade, the through/around roller disposed upstream from the peel blade edge, wherein the rotary encoder is positioned on the peel blade, wherein the linear speed of the carrier strip through the applicator is controlled by adjusting the speed of the motor, and wherein the rotary encoder monitors the linear speed of the carrier strip and communicates with the controller to monitor and control the linear speed of the carrier strip by providing a closed-loop feedback to the controller, and wherein the carrier strip is fed along a forward path to be received at the peel blade, and the carrier strip passes from the peel blade to the rewind reel under a roller along a rearward path extending from the peel blade to the rewind reel in a single direction only, and the forward path is parallel to the rearward path.

11. The label applicator of claim 10, wherein the rotary encoder is at least one of an absolute rotary encoder, an incremental rotary encoder, an optical rotary encoder, and a mechanical rotary encoder.

12. The label applicator of claim 10, wherein the carrier strip passes parallel and adjacent to a first and a second side of the peel blade.

* * * * *